United States Patent [19]

Journee

[11] Patent Number: 4,716,746

[45] Date of Patent: Jan. 5, 1988

[54] KEY OPERATED LOCK MECHANISM LOCKABLE IN THE ABSENCE OF A KEY

[75] Inventor: Maurice A. Journee, Reilly, France

[73] Assignee: Paul Journee, S.A., Courbevoie, France

[21] Appl. No.: 803,192

[22] Filed: Dec. 2, 1985

[30] Foreign Application Priority Data

Dec. 12, 1984 [FR] France ..... 84 18969

[51] Int. Cl.[4] ..... B65D 55/14

[52] U.S. Cl. ..... 70/161; 70/162

[58] Field of Search ..... 70/159–162, 70/379 R, 380, 158, 178, 232, 134; 215/207; 220/210, DIG. 33

[56] References Cited

U.S. PATENT DOCUMENTS

| | | | |
|---|---|---|---|
| 183,738 | 10/1876 | Winslow et al. | 70/162 |
| 1,826,023 | 10/1931 | Roberts | 70/162 |
| 1,835,304 | 12/1931 | Jacobi | 70/216 |
| 2,345,809 | 4/1944 | Greenberg | 70/162 |
| 2,645,927 | 7/1953 | McConnell et al. | 70/216 |
| 4,068,510 | 1/1978 | Neary | 70/379 R |
| 4,470,276 | 9/1984 | Bayless | 70/380 X |
| 4,563,885 | 1/1986 | Madden | 70/380 X |

FOREIGN PATENT DOCUMENTS

| | | | |
|---|---|---|---|
| 0187264 | 7/1986 | European Pat. Off. | 70/100 |
| 47000 | 4/1977 | Japan | 70/380 |

*Primary Examiner*—Lloyd A. Gall

*Attorney, Agent, or Firm*—Dowell & Dowell

[57] ABSTRACT

A lock mechanism is provided with a housing having a closable flap pivoted thereon. The flap carries a key releasable lock cylinder equipped with locking elements and a locking bolt slidable under the action of a return spring. The locking bolt comprises a shoulder cooperating with a stud mounted on a cam plate which pivots to bring the bolt into the open position against the action of the return spring, whereby the bolt is disengaged from a fixed abutment. The cylinder and cam plate can occupy a locking position (v) in which the locking elements are resiliently urged into a locked position within locking grooves formed in the closable flap so that the stud locks the bolt. When the cylinder and cam plate are moved to a second position (F) angularly displaced from the locking position (v) the stud frees the locking bolt so that the bolt can move for the purpose of locking or unlocking the flap whether or not the key is present in the lock mechanism.

2 Claims, 3 Drawing Figures

KEY OPERATED LOCK MECHANISM LOCKABLE IN THE ABSENCE OF A KEY

BACKGROUND TO THE INVENTION

The invention relates to a locking device which can be locked without a key but necessitates a key for unlocking.

Such a device is very useful for applications in which it is desired to be able to use a lock without it being automatically locked at every utilization. This is the case for example with a petrol filler closure flap for an automobile vehicle, a luggage lock, or an apartment door lock.

In general, with such devices the locking and unlocking are effected by means of a key, independently of the lock, even when the bolt is combined with the lock.

OBJECT OF THE INVENTION

An object of the present invention is to provide a lock mechanism which permits locking without utilizing the key, by means of simple, reliable, effective and economical means.

SUMMARY OF THE INVENTION

According to the invention there is provided a lock mechanism comprising a. a body portion having abutment means formed thereon, b. a cover portion pivotally mounted on said body portion between a closed position and an open position, said cover portion being formed with a substantially cylindrical boss, c. a key releasable lock cylinder having a plurality of locking elements rotatable within said boss, d. a slidable locking bolt on said cover portion engageable with said abutment means, e. spring return means arranged between said cover portion and said locking bolt to urge the latter into a locking position, said locking bolt having a shoulder formed thereon, f. a knob connected with said lock cylinder to rotate therewith, movable between a first position where the elements effect locking in the absence of key release and in a second position on key release angularly displaced from the first position thereof, and g. a stud mounted on said knob capable of engaging said shoulder on rotation of the knob to an opening position on key release to effect a sliding motion of said locking bolt against said return means to a position at which the latter disengages the abutment means.

In the case where the lock is of the pin tumbler type, the return means are constituted by the pin tumbler springs. In the case of a piston lock the return means are constituted by the stator piston springs.

BRIEF DESCRIPTION OF DRAWINGS

The invention will be clearly understood on reading of the following description of an example of embodiment given with reference to the accompanying drawing, wherein.

DESCRIPTION OF PREFERRED EMBODIMENTS

Figure 1:
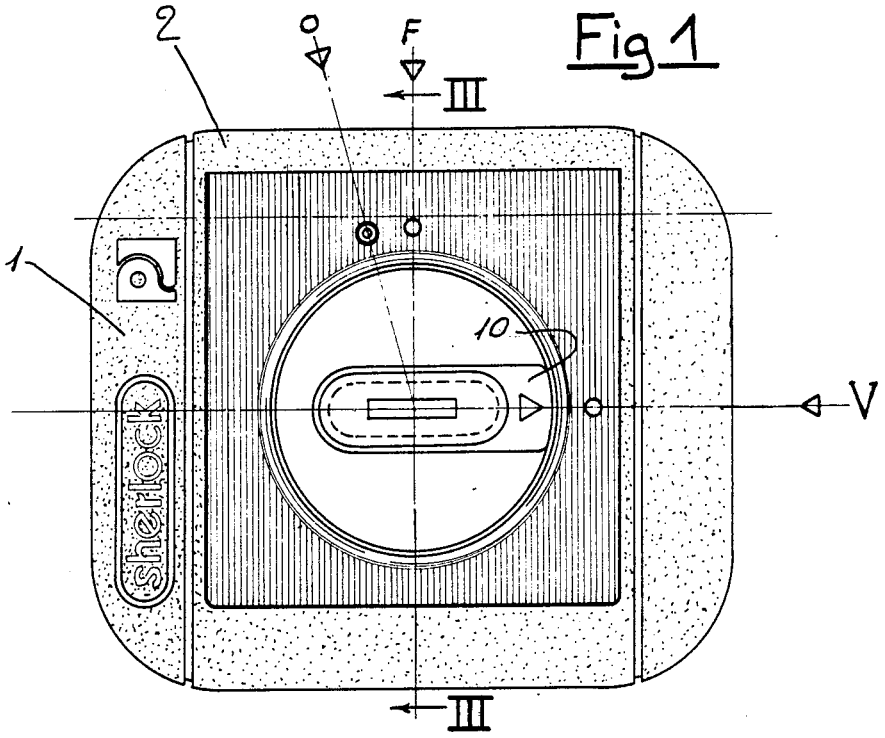
FIG. 1 is a plan view of a pivoting lid equipped with a lock according to the invention.
Figure 3:
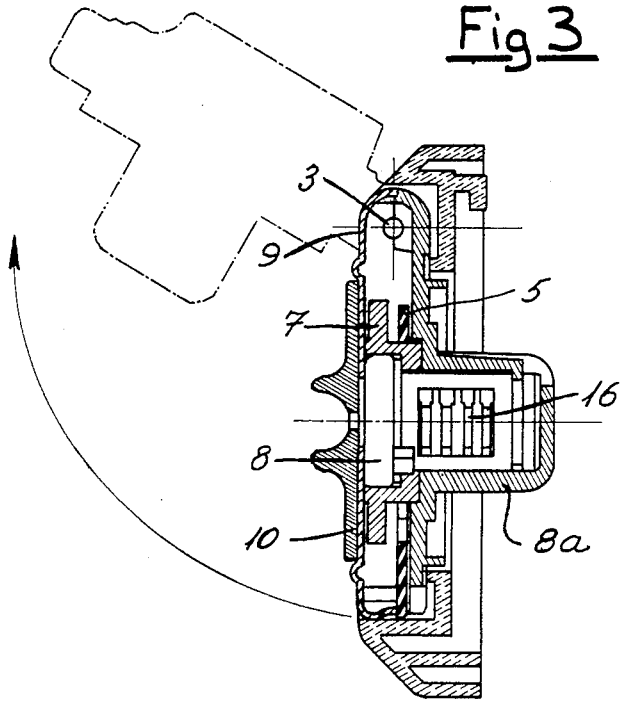
FIG. 3 is a sectional view along the line III—III in FIG. 1.

In the example as described the lock comprises a fixed body 1 on which a flap 2 is pivoted about a spindle 3, being returned into the open position by a torsion spring 4. In the flap 2 a locking bolt 5 slides under the action of a helical compression spring 6 returning it into the locking position wherein end portions thereof are retained in locked engagement beneath a pair of abutment members 5*a* which are integrally formed with the body 1 of the lock. A cam 7 fast in rotation with a pin tumbler cylinder 8 which is positioned within a substantially cylindrical boss 8*a* formed on the flap 2 and enclosed by a cover 9. The cam 7 and the cylinder 8 are fast in rotation with a rotating control knob 10. The body 1 is fixed on a base piece by a screw 11.

The bolt 5 comprises a cut-out window 12 in which the cam 7 pivots. The window 12 is equipped with a shoulder 13 with which there co-operates a stud 14 fast with the cam 7, in the passage of the knob 10 from a closure position F to an open position 0, in order to thrust back the bolt 5 against the action of the spring 6 and cause the opening of the lock and the pivoting of the flap 2 under the action of its spring 4.

Figure 2:
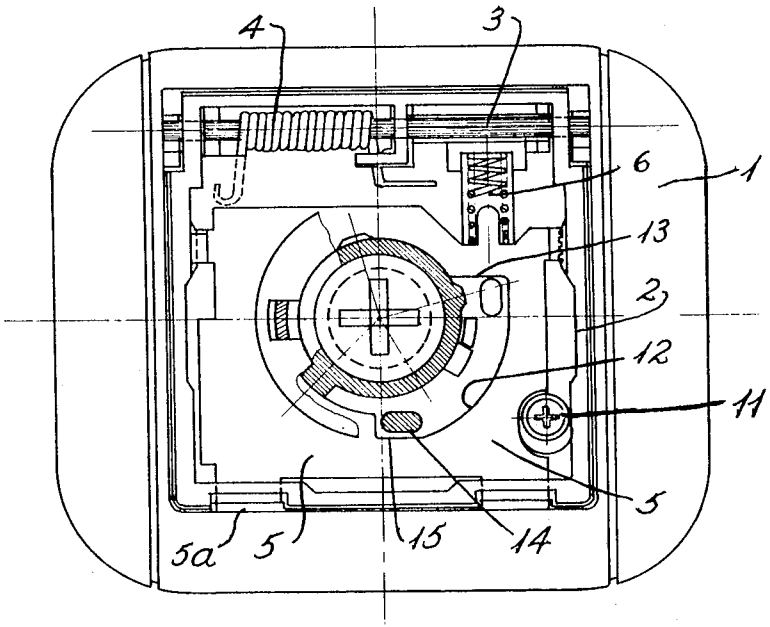
FIG. 2 is a plan view of the lid according to FIG. 1, after removal of the control knob and the lid.

The window 12 comprises a diametrical narrowed portion 15 with which the stud 14 co-operates, in a locking angular position V of the rotating knob 10 (FIG. 2), to lock the bolt 5 in the locking position.

In this angular position V the cylinder 8 has arrived in a position such that its pin tumblers 16 face diametrically opposite grooves 17 formed in the flap 2 and under the action of their return springs (not shown) the tumblers come to lodge in these grooves locking the cylinder 8 in rotation. The cam 7 and the knob 10, which are fast in rotation with the cylinder 8, are likewise immobilized.

In order to unlock the lock the suitable notched key must be introduced into the cylinder 8 and brings the pin tumblers within the cylinder 8 and frees the rotating assembly 7, 8, 10. Then it is possible to rotate the knob 10 to the position F, then withdraw the key. The pin tumblers of the cylinder 8, which no longer face the locking grooves, are no longer an impediment to rotation.

I claim:

1. A locking mechanism which is selectively operable by use of a separate key comprising a. a body portion having abutment means formed thereon, b. a flap portion pivotally mounted on said body portion between a closed position and an open position, means for biassing said flap portion to said open position, said flap portion being formed with a substantially cylindrical boss having a pair of opposing grooves therein and which boss defines a cylindrical bore, c. a slidable locking bolt on said flap portion engageable with said abutment means, d. spring return means arranged between said flap portion and said locking bolt to urge said locking bolt towards a locking position, said locking bolt having a shoulder formed thereon, e. a lock cylinder having a plurality of locking elements normally seated within said opposing grooves to thereby lock said lock cylinder relative to said flap portion in a first position, said lock cylinder being rotatable within said cylindrical bore of said cylindrical boss, upon the insertion of the key therein, between said first position and a second position where said locking pin elements are remote from said opposing grooves to thereby retain said lock cylinder unlocked within said cylindrical boss under conditions wherein the key is selectively removed from said lock cylinder, said lock cylinder also being rotatable between said second position and a third position, which third position is beyond the rotational range between said first and second positions, f. a cam plate connected with said lock cylinder to rotate therewith, and g. a stud mounted on said cam plate capable of engaging said shoulder upon rotation said lock cylinder to said third position to effect a sliding motion of said locking bolt against said return means to thereby disengage said locking bolt from said abutment means, said stud permitting movement of said locking bolt when said lock cylinder is in said second position and effecting locking of said locking bolt when said lock cylinder is in said first position.

2. The locking mechanism of claim 1, wherein said locking bolt is formed with a window defined by an interior edge which includes said shoulder and a second shoulder, said stud resting adjacent said second shoulder when said lock cylinder is in said first position to lock said locking bolt in a locked position.

* * * * *